US011359813B2

(12) United States Patent
Roh et al.

(10) Patent No.: US 11,359,813 B2
(45) Date of Patent: Jun. 14, 2022

(54) COMBUSTOR AND GAS TURBINE INCLUDING THE SAME

(71) Applicant: DOOSAN HEAVY INDUSTRIES & CONSTRUCTION CO., LTD., Changwon-si (KR)

(72) Inventors: U Jin Roh, Changwon-si (KR); Mu Hwan Chon, Changwon-si (KR)

( * ) Notice: Subject to any disclaimer, the term of this patent is extended or adjusted under 35 U.S.C. 154(b) by 0 days.

(21) Appl. No.: 16/998,247

(22) Filed: Aug. 20, 2020

(65) Prior Publication Data

US 2021/0348763 A1 Nov. 11, 2021

(30) Foreign Application Priority Data

May 7, 2020 (KR) ..... 10-2020-0054506

(51) Int. Cl.

| | |
|---|---|
| ***F23R 3/26*** | (2006.01) |
| ***F23R 3/28*** | (2006.01) |
| ***F23R 3/34*** | (2006.01) |
| ***F23R 3/36*** | (2006.01) |

(52) U.S. Cl.

CPC ..... *F23R 3/286* (2013.01); *F23R 3/26* (2013.01); *F23R 3/34* (2013.01); *F23R 3/36* (2013.01); *F23C 2900/07001* (2013.01)

(58) Field of Classification Search

CPC ..... F23R 3/04; F23R 3/10; F23R 3/16; F23R 3/26; F23R 3/286; F23R 3/34; F23R 3/343; F23R 3/346

See application file for complete search history.

(56) References Cited

U.S. PATENT DOCUMENTS

| | | | | |
|---|---|---|---|---|
| 6,634,175 | B1 * | 10/2003 | Kawata | F23R 3/04 60/746 |
| 8,371,123 | B2 | 2/2013 | Stewart et al. | |
| 8,950,188 | B2 * | 2/2015 | Stewart | F23R 3/10 60/747 |
| 8,991,187 | B2 | 5/2015 | Hughes et al. | |

(Continued)

FOREIGN PATENT DOCUMENTS

| | | | |
|---|---|---|---|
| JP | 2000346361 | A | 12/2000 |
| KR | 1020140056024 | A | 5/2014 |

(Continued)

OTHER PUBLICATIONS

KR OA dated Mar. 26, 2021, No English translation provided.

*Primary Examiner* — William H Rodriguez
(74) *Attorney, Agent, or Firm* — Harvest IP Law, LLP

(57) ABSTRACT

A combustor and a gas turbine capable of uniformly supplying air into a burner are provided. The combustor may include a burner including a tubular nozzle casing, a head plate coupled to an end of the nozzle casing, and a plurality of nozzles to inject fuel and air, and a duct assembly coupled to the burner, a mixture of the fuel and the air being burned in the duct assembly to produce combustion gas. Each of the nozzles may include outer nozzles and an inner nozzle installed inside the outer nozzles, each of the outer nozzles may include a nozzle tube configured to provide a channel through which air and fuel flow and a nozzle shroud configured to surround the nozzle tube, and a flow distribution member may be installed between the head plate and the nozzle shroud to distribute a flow rate of air introduced into the outer nozzle.

15 Claims, 9 Drawing Sheets

(56) References Cited

U.S. PATENT DOCUMENTS

| | | | | |
|---|---|---|---|---|
| 10,845,055 | B2 * | 11/2020 | Roh | F23R 3/10 |
| 10,955,139 | B2 * | 3/2021 | Uhm | F23R 3/28 |
| 10,995,958 | B2 * | 5/2021 | Shershnyov | F23D 14/58 |
| 2005/0268614 | A1 * | 12/2005 | Widener | F23R 3/286 60/772 |
| 2007/0277530 | A1 * | 12/2007 | Dinu | F23R 3/286 60/772 |
| 2009/0173074 | A1 * | 7/2009 | Johnson | F23R 3/28 60/737 |
| 2009/0223225 | A1 * | 9/2009 | Kraemer | F23R 3/286 60/723 |
| 2010/0132364 | A1 * | 6/2010 | Myers | F23R 3/283 60/748 |
| 2010/0275605 | A1 * | 11/2010 | Hase | F23R 3/286 60/748 |
| 2011/0094232 | A1 * | 4/2011 | Stewart | F23R 3/14 60/734 |
| 2012/0024985 | A1 * | 2/2012 | Johnson | F23R 3/286 239/518 |
| 2013/0025285 | A1 * | 1/2013 | Stewart | F02C 7/2365 60/740 |
| 2017/0074519 | A1 * | 3/2017 | Abe | F23R 3/10 |
| 2018/0299128 | A1 * | 10/2018 | Shim | F23R 3/54 |
| 2019/0011129 | A1 * | 1/2019 | Uhm | F23R 3/16 |
| 2019/0056111 | A1 * | 2/2019 | Miyamoto | F23R 3/26 |
| 2020/0056545 | A1 * | 2/2020 | Jin | F02C 7/22 |

FOREIGN PATENT DOCUMENTS

| | | | |
|---|---|---|---|
| KR | 1020170031048 | A | 3/2017 |
| KR | 101872801 | B1 | 6/2018 |

* cited by examiner

COMBUSTOR AND GAS TURBINE INCLUDING THE SAME

CROSS-REFERENCE TO RELATED APPLICATION

This application claims priority to Korean Patent Application No. 10-2020-0054506 filed on May 7, 2020, the disclosure of which is incorporated herein by reference in its entirety.

BACKGROUND

Technical Field

Apparatuses and methods consistent with exemplary embodiments relate to a combustor and a gas turbine including the same.

Description of the Related Art

A gas turbine is a power engine that mixes air compressed by a compressor with fuel for combustion and rotates a turbine using a high-temperature gas generated by the combustion. The gas turbine is used to drive a generator, an aircraft, a ship, a train, etc.

The gas turbine includes a compressor, a combustor, and a turbine. The compressor sucks and compresses outside air, and then transmits the compressed air to the combustor. The air compressed by the compressor is in a high-pressure and high-temperature state. The combustor mixes the compressed air supplied from the compressor with fuel and burns a mixture thereof. The combustion gas generated by the combustion is discharged to the turbine. Turbine blades provided in the turbine are rotated by the combustion gas, thereby generating power. The generated power is used in various fields, such as generating electric power and actuating machines.

The air compressed by the compressor is supplied to the combustor, and introduced into nozzles while flows along an inside of a nozzle casing in the combustor. In order to supply air to an end of each nozzle in which combustion occurs, the air is supplied toward a nozzle head plate, and then turned in an opposite direction.

As such, because the direction of the flow of air for combusting fuel is rapidly changed at the nozzle head plate, strong swirls may be generated during this process. The strong swirl has multiple velocity components that are oriented in the direction different from or opposite to the actual direction of flow of air, which in turn causes a loss of pressure and decreases the efficiency of air flow.

In addition, such swirls may cause a large amount of air to flow outside burners rather than flowing to centers of the burners. Therefore, if air is not uniformly supplied to the burners, the combustion efficiency of the combustor may be decreased and nitrogen oxides may thus be increased.

SUMMARY

Aspects of one or more exemplary embodiments provide a combustor capable of uniformly supplying air into a burner, and a gas turbine including the same.

Additional aspects will be set forth in part in the description which follows and, in part, will become apparent from the description, or may be learned by practice of the exemplary embodiments.

According to an aspect of an exemplary embodiment, there is provided a combustor including: a burner including a tubular nozzle casing, a head plate coupled to an end of the nozzle casing, and a plurality of nozzles to inject fuel and air, and a duct assembly coupled to the burner, the fuel being burned in the duct assembly to produce combustion gas. Each of the nozzles may include outer nozzles and an inner nozzle installed inside the outer nozzles, each of the outer nozzles may include a nozzle tube configured to provide a channel through which air and fuel flow, and a nozzle shroud configured to surround the nozzle tube, and a flow distribution member may be installed between the head plate and the nozzle shroud to distribute a flow rate of air introduced into the outer nozzle.

The flow distribution member may be spaced apart from the nozzle shroud to define a first distribution channel between the flow distribution member and the nozzle shroud. The flow distribution member may be spaced apart from the head plate to define a second distribution channel between the flow distribution member and the head plate.

A flow guide member having a curved guide surface may be installed at a corner in which the nozzle casing meets the head plate. The second distribution channel may be defined between the flow guide member and the flow distribution member.

A volume of the second distribution channel may be larger than a volume of the first distribution channel.

A gap between the nozzle shroud and an extension line, extending toward a central axis of the outer nozzle from an upper end of the flow distribution member, may be larger than a gap between the extension line and the nozzle casing.

The flow distribution member may include an induction plate and a distribution plate obliquely bent from an inner end of the induction plate.

A first angle formed by the induction plate and a reference axis parallel to the head plate may be greater than a second angle formed by the distribution plate and the reference axis.

The flow distribution member may further include a guide plate extending from the induction plate in a direction of introduced air.

The guide plate may be inclined toward a center of the burner with respect to a direction parallel to a central axis of the outer nozzle.

A gap between an upper end of the guide plate and the nozzle casing may be larger than a gap between the upper end of the guide plate and the nozzle shroud.

The flow distribution member may include a first flow distribution member and a second flow distribution member spaced apart from the first flow distribution member with a gap therebetween. The first flow distribution member may be disposed between the nozzle shroud and the second flow distribution member, and the second flow distribution member may be disposed between the nozzle casing and the first flow distribution member.

The first flow distribution member may include a first induction plate inclined with respect to a direction of introduced air, a first distribution plate bent from an inner end of the first induction plate, and a first guide plate extending from an outer end of the first induction plate in the direction of introduced air. The second flow distribution member may include a second induction plate inclined with respect to the direction of introduced air, a second distribution plate bent from an inner end of the second induction plate, and a second guide plate extending from an outer end of the second induction plate in the direction of introduced air.

A gap between an upper end of the first guide plate and the nozzle shroud may be smaller than a gap between the upper end of the first guide plate and an upper end of the second guide plate.

A gap between the first guide plate and the second guide plate may gradually decrease toward the head plate.

The flow distribution member may include a plurality of guide ribs protruding therefrom, each of the guide ribs extending in a direction of flow of air.

According to an aspect of another exemplary embodiment, there is provided a combustor including: a burner including a tubular nozzle casing, a head plate coupled to an end of the nozzle casing, and a plurality of nozzles to inject fuel and air. Each of the nozzles may include outer nozzles and an inner nozzle installed inside the outer nozzles, each of the outer nozzles may include a nozzle tube configured to provide a channel through which air and fuel flow and a nozzle shroud configured to surround the nozzle tube, a flow distribution member may be installed between the head plate and the nozzle shroud to distribute a flow rate of air introduced into the outer nozzle, and the flow distribution member may include an induction plate and a distribution plate obliquely bent from an inner end of the induction plate.

According to an aspect of another exemplary embodiment, there is provided a gas turbine including: a compressor configured to compress air introduced from an outside; a combustor configured to mix fuel with the air compressed by the compressor and combust a mixture of the fuel and the compressed air; and a turbine including a plurality of turbine blades configured to be rotated by combustion gas produced by the combustor. The combustor may include a burner including a plurality of nozzles to inject fuel and air, and a duct assembly coupled to the burner, the mixture of the fuel and the air being burned in the duct assembly to produce the combustion gas. Each of the nozzles may include outer nozzles and an inner nozzle installed inside the outer nozzles, each of the outer nozzles may include a nozzle tube configured to provide a channel through which air and fuel flow and a nozzle shroud configured to surround the nozzle tube, and a flow distribution member may be installed between the head plate and the nozzle shroud to distribute a flow rate of air introduced into the outer nozzle.

The flow distribution member may be spaced apart from the nozzle shroud to define a first distribution channel between the flow distribution member and the nozzle shroud. The flow distribution member may be spaced apart from the head plate to define a second distribution channel between the flow distribution member and the head plate.

A flow guide member having a curved guide surface may be installed at a corner in which the nozzle casing meets the head plate. The second distribution channel may be defined between the flow guide member and the flow distribution member.

A volume of the second distribution channel may be larger than a volume of the first distribution channel.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
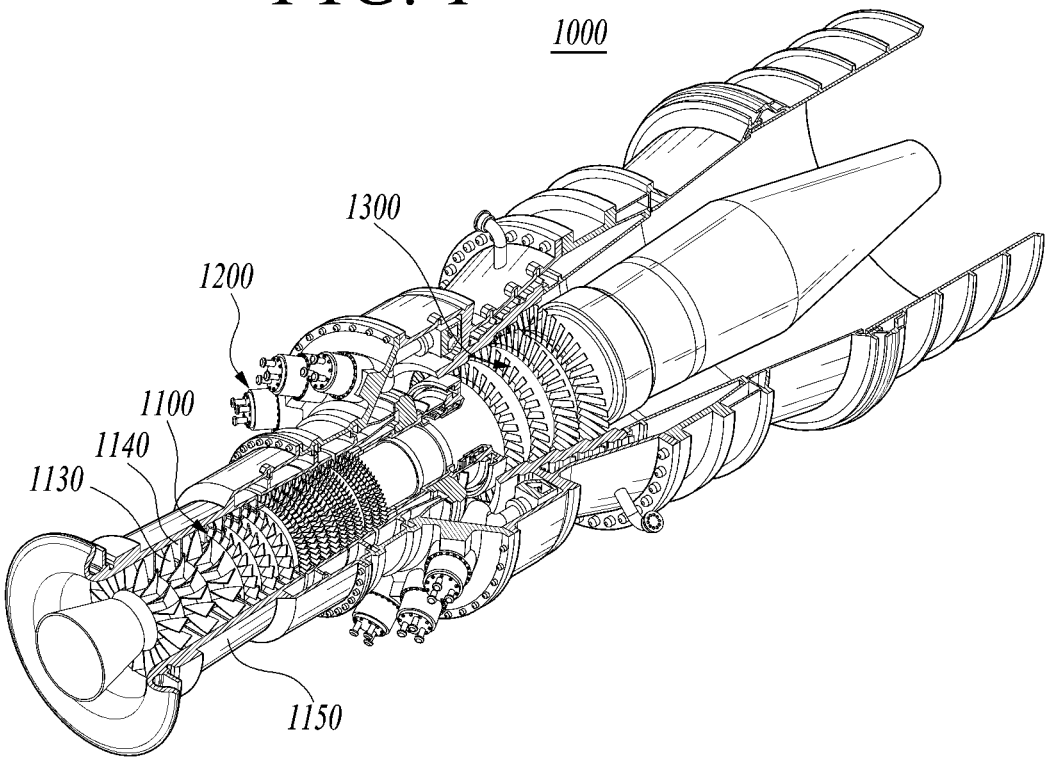
FIG. 1 is a view illustrating an interior of a gas turbine according to a first exemplary embodiment.

Various modifications may be made to the embodiments of the disclosure, and there may be various types of embodiments. Thus, specific embodiments will be illustrated in the accompanying drawings and the embodiments will be described in detail in the description. It should be understood, however, that the various embodiments are not for limiting the scope of the disclosure to a specific embodiment, but they should be interpreted to include all modifications, equivalents, and alternatives of the embodiments included within the spirit and scope disclosed herein. Meanwhile, in case it is determined that in describing the embodiments, detailed explanation of related known technologies may unnecessarily confuse the gist of the disclosure, the detailed explanation will be omitted.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, exemplary embodiments will be described in detail with reference to the accompanying drawings. It should be noted that like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
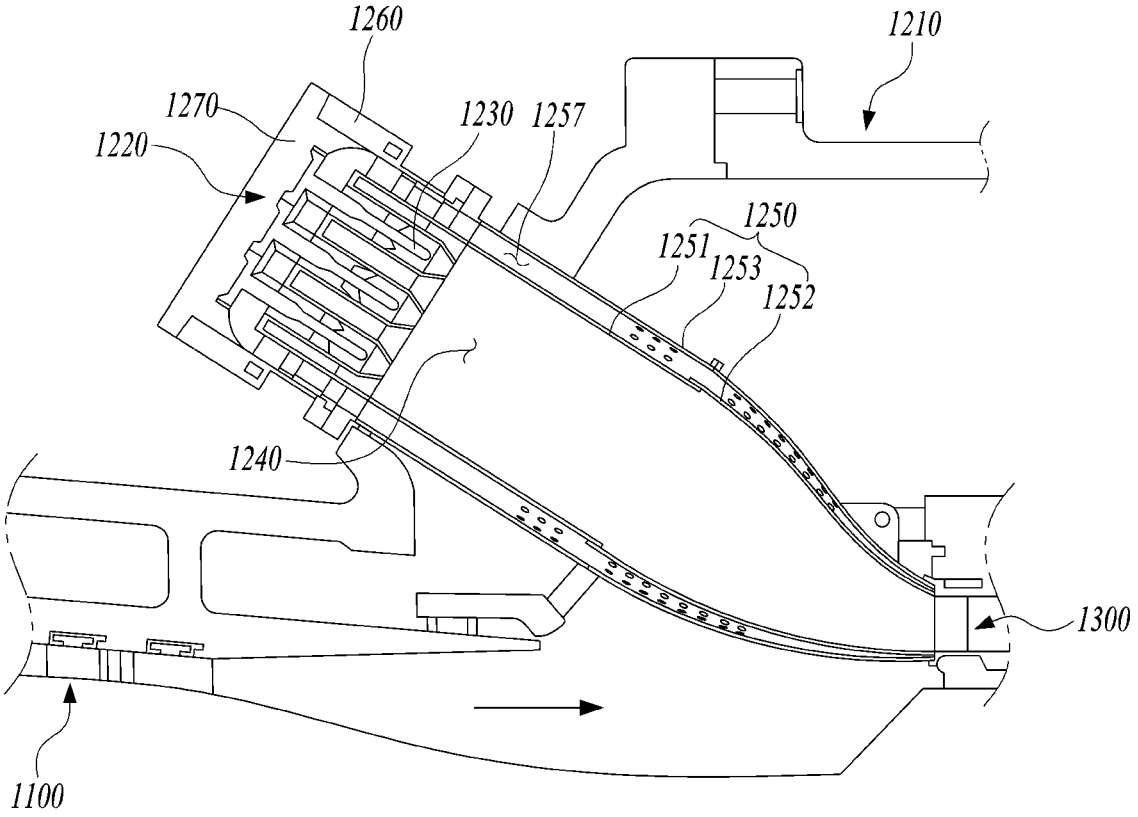
FIG. 2 is a view illustrating a combustor of FIG. 1.

FIG. 1 is a view illustrating an interior of a gas turbine according to a first exemplary embodiment. FIG. 2 is a view illustrating a combustor of FIG. 1.

The thermodynamic cycle of the gas turbine 1000 according to the exemplary embodiment may ideally comply with a Brayton cycle. The Brayton cycle consists of four phases including an isentropic compression (i.e., an adiabatic compression), an isobaric heat addition, an isentropic expansion (i.e., an adiabatic expansion), and an isobaric heat dissipation. In other words, the gas turbine may draw air from the atmosphere, compress the air to a high pressure, combust a fuel under isobaric conditions to emit a thermal energy, expand this high-temperature combustion gas to convert the thermal energy of the combustion gas into kinetic energy, and discharge exhaust gas with residual energy to the atmosphere. The Brayton cycle consists of four processes including compression, heating, expansion, and exhaust.

The gas turbine 1000 using the Brayton cycle may include a compressor 1100, a combustor 1200, and a turbine 1300, as illustrated in FIG. 1. Although the following description is given with reference to FIG. 1, the present disclosure may be widely applied to a gas turbine having the same configuration as the gas turbine 1000 exemplarily illustrated in FIG. 1.

Referring to FIG. 1, the compressor 1100 of the gas turbine 1000 may suck air from the outside and compress the air. The compressor 1100 may supply the air compressed by compressor blades 1130 to the combustor 1200, and may supply cooling air to a high-temperature region required for cooling in the gas turbine 1000. In this case, because the sucked air is compressed in the compressor 1100 through an adiabatic compression process, the pressure and temperature of the air passing through the compressor 1100 increase.

The compressor 1100 may be designed as a centrifugal compressor or an axial compressor. In general, the centrifugal compressor is applied to a small gas turbine, whereas the multistage axial compressor 1100 is applied to the large gas turbine such as the gas turbine 1000 illustrated in FIG. 1 so as to compress a large amount of air. In the multistage axial compressor 1100, the compressor blades 1130 rotate along with rotation of rotor disks to compress air introduced thereinto while moving the compressed air to rear-stage compressor vanes 1140. The air is compressed gradually to a high pressure while passing through the compressor blades 1130 formed in a multi-stage structure.

A plurality of compressor vanes 1140 may be formed in a multistage manner and mounted in a housing 1150. The compressor vanes 1140 guide the compressed air transferred from compressor blades 1130 disposed at a preceding stage to compressor blades 1130 disposed at a following stage. For example, at least a portion of the compressor vanes 1140 may be mounted so as to be rotatable within a predetermined range for regulating the inflow rate of air or the like.

The compressor 1100 may be actuated by some of the power output from the turbine 1300. To this end, a rotary shaft of the compressor 1100 may be directly connected to a rotary shaft of the turbine 1300, as illustrated in FIG. 1. In the large gas turbine 1000, the compressor 1100 may require about half of the power generated in the turbine 1300 for actuation. Accordingly, an overall efficiency of the gas turbine 1000 can be enhanced by directly increasing the efficiency of the compressor 1100.

The combustor 1200 may mix the compressed air supplied from the compressor 1100 with fuel through an isobaric combustion to produce combustion gas with high energy. FIG. 2 illustrates an example of the combustor 1200 applied to the gas turbine 1000. The combustor 1200 may include a combustor casing 1210, a burner 1220, a nozzle 1230, a duct assembly 1250, a flow guide member 1400, and a flow distribution member 1500.

The combustor casing 1210 may have a substantially cylindrical shape to surround a plurality of burners 1220. The burners 1220 may be disposed at a downstream side of the compressor 1100 and arranged along the combustor casing 1210 having an annular shape. Each of the burners 1220 includes a plurality of nozzles 1230, and the fuel injected from the nozzles 1230 is mixed with air at an appropriate rate to form a mixture having conditions suitable for combustion.

The gas turbine 1000 may use gas fuel, liquid fuel, or composite fuel as a combination thereof. It is important to make a combustion environment for reducing an amount of emission such as carbon monoxide or nitrogen oxide. Accordingly, premixed combustion has been increasingly used because it enables uniform combustion to reduce emission by lowering a combustion temperature even though it is difficult to control the premixed combustion.

In the premixed combustion, compressed air is mixed with the fuel injected from the nozzles 1230 in advance, and then enters into a combustion chamber 1240. If combustion is stable after premixed gas is initially ignited by an igniter, the combustion is maintained by supplying fuel and air.

Referring to FIG. 2, compressed air is supplied to the nozzles 1230 along an outer surface of the duct assembly 1250, which connects an associated one of the burners 1220 to the turbine 1300 so that high-temperature combustion gas flows through the duct assembly 1250. In this process, the duct assembly 1250 heated by the high-temperature combustion gas is properly cooled.

The duct assembly 1250 may include a liner 1251, a transition piece 1252, and a flow sleeve 1253. The duct assembly 1250 has a double-shell structure in which the flow sleeve 1253 surrounds the liner 1251 and the transition piece 1252. The liner 1251 and the transition piece 1252 are cooled by the compressed air drawn into a cooling passage 1257 formed inside the flow sleeve 1253.

The liner 1251 is a tubular member connected to the burner 1220 of the combustor 1200, and the combustion chamber 1240 is a space inside the liner 1251. The liner 1251 is configured such that one longitudinal end thereof is coupled to the burner 1220 and the other longitudinal end thereof is coupled to the transition piece 1252.

The transition piece 1252 is connected to an inlet of the turbine 1300 and serves to guide high-temperature combustion gas to the turbine 1300. The transition piece 1252 is configured such that one longitudinal end thereof is coupled to the liner 1251 and the other longitudinal end thereof is coupled to the turbine 1300. The flow sleeve 1253 serves to protect the liner 1251 and the transition piece 1252 while preventing high-temperature heat from being directly released to the outside.

A nozzle casing 1260 is coupled to an end of the duct assembly 1250, and a head plate 1270 for supporting the nozzles 1230 is coupled to the nozzle casing 1260.

Figure 3:
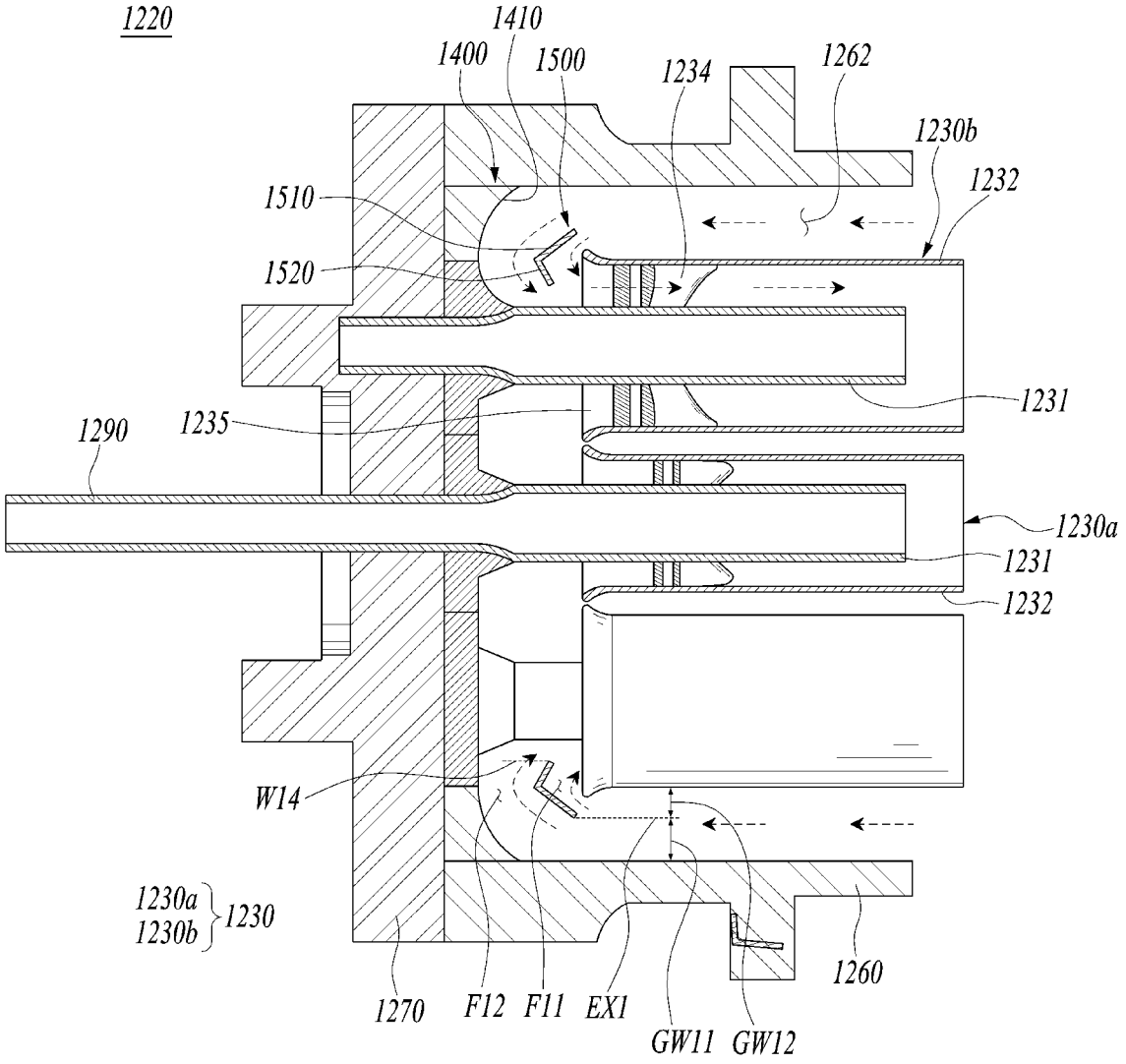
FIG. 3 is a cross-sectional view illustrating a portion of the combustor according to the first exemplary embodiment.

FIG. 3 is a cross-sectional view illustrating a portion of the combustor according to the first exemplary embodiment.

Referring to FIGS. 2 and 3, the nozzle casing 1260 is formed of a substantially circular tube and configured to surround the nozzles 1230. One end of the nozzle casing 1260 is coupled to the duct assembly 1250 and the other end of the nozzle casing 1260 is coupled to the head plate 1270 installed at a rear of the nozzle casing 1260. The nozzles 1230 may be installed in the nozzle casing 1260. The nozzles 1230 may be spaced apart from each other in a circumferential direction of the nozzle casing 1260.

Between the nozzle casing 1260 and each nozzle 1230, a flow channel 1262 through which air flows is defined. Each of the nozzles 1230 may include a central inner nozzle 1230*a* and outer nozzles 1230*b* surrounding the inner nozzle 1230*a*. It is understood that the nozzles 1230 including one inner nozzle 1230*a* and five outer nozzles 1230*b* may not be limited to the example illustrated in FIG. 3, and may be changed or vary according to one or more other exemplary embodiments. For example, the nozzles 1230 may include one inner nozzle and a plurality of outer nozzles.

The head plate 1270 has a disk shape, and is coupled to the nozzle casing 1260 to support the nozzles 1230. The head plate 1270 may be equipped with a fuel injector 1290 to supply fuel to the nozzles 1230.

Each of the outer nozzles 1230*b* may include a nozzle tube 1231, a nozzle shroud 1232 surrounding the nozzle tube 1231, and a nozzle vane 1234 installed between the nozzle tube 1231 and the nozzle shroud 1232 to inject fuel. The inner nozzle 1230*a* may include a nozzle tube 1231, a nozzle shroud 1232 surrounding the nozzle tube 1231, and a nozzle vane 1234 installed between the nozzle tube 1231 and the nozzle shroud 1232 to inject fuel.

The nozzle tube 1231 and the nozzle shroud 1232 have a coaxial structure, and the nozzle tube 1231 has a channel defined therein so that fuel and air flow through the channel. The nozzle shroud 1232 has a channel defined therein so that air flows through the channel. Fuel may be injected through the nozzle vane 1234.

Air is introduced into a gap formed between the nozzle shroud 1232 and the nozzle tube 1231, and an inlet 1235 may be formed at a rear end of the nozzle shroud 1232 to introduce air through the inlet 1235. The nozzle vane 1234 induces a swirl in the channel defined between the nozzle tube 1231 and the nozzle shroud 1232, and may have a plurality of holes so that fuel is injected through the plurality of holes.

The air flowing along the cooling passage 1257 is introduced into the nozzle casing 1260 and reaches the head plate 1270. The flow guide member 1400 is disposed at a corner in which the nozzle casing 1260 meets the head plate 1270 so that the direction of flow of air is changed at the corner. The flow guide member 1400 serves to guide the flow of air, e.g., to guide air to easily enter the nozzle 1230.

The flow guide member 1400 may extend in the circumferential direction of the nozzle casing 1260 and have an annular shape, e.g., a circular ring shape. In addition, the flow guide member 1400 may include an arc-shaped curved guide surface 1410 to guide the flow of air.

Figure 4:
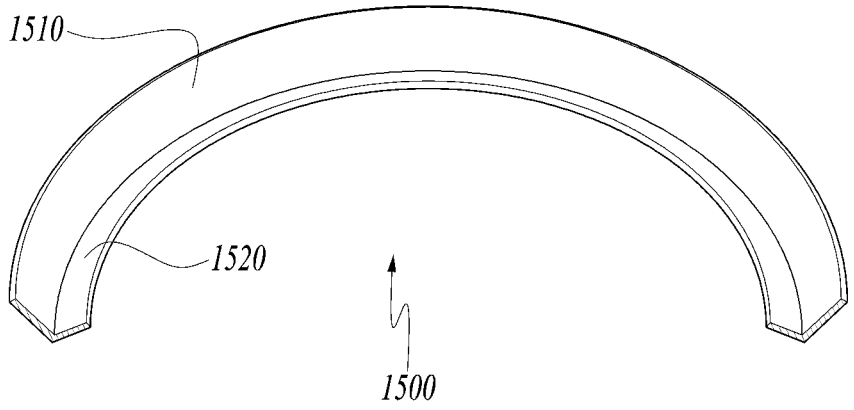
FIG. 4 is a cut-away perspective view illustrating a flow distribution member according to the first exemplary embodiment.
Figure 5:
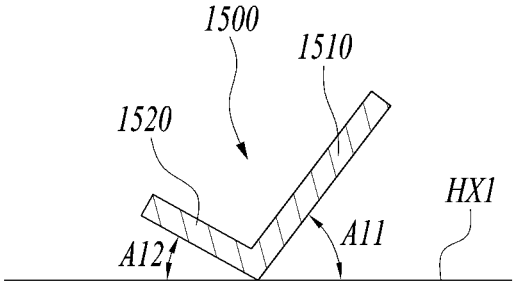
FIG. 5 is a longitudinal sectional view illustrating the flow distribution member according to the first exemplary embodiment.

FIG. 4 is a cut-away perspective view illustrating the flow distribution member according to the first exemplary embodiment. FIG. 5 is a longitudinal sectional view illustrating the flow distribution member according to the first exemplary embodiment.

Referring to FIGS. 3 to 5, the flow distribution member 1500 is installed between the nozzle shroud 1232 and the head plate 1270 to distribute a flow rate of air supplied to the inlet 1235. The flow distribution member 1500 is spaced apart from the head plate 1270 to define a channel for air flow between the flow distribution member 1500 and the head plate 1270.

Although a considerable amount of air is introduced into the burner 1220 from the outside, an amount of air reaching a center of the burner 1220 is relatively small. Accordingly, the flow distribution member 1500 defines two channels so that the flow rate of air is distributed through the channels, thereby enabling a sufficient amount of air to flow to the center of the burner 1220.

The flow distribution member 1500 may have a ring shape, e.g., a circular ring shape. The flow distribution member 1500 may be fixed to the nozzle casing 1260 or the nozzle shroud 1232 via a support (not shown) or the like. The flow distribution member 1500 may include an induction plate 1510 inclined with respect to the direction of introduced air, and a distribution plate 1520 obliquely bent from an inner end of the induction plate 1510. Here, both the induction plate 1510 and the distribution plate 1520 may be a flat plate.

The induction plate 1510 is disposed further from the center of the burner 1220 than the distribution plate 1520, and is inclined toward a central axis of the outer nozzle 1230*b*. The distribution plate 1520 is bent from the inner end of the induction plate 1510 to protrude inward, and extends from the induction plate 1510 in a direction away from the head plate 1270.

A first angle A11 formed by the induction plate 1510 and a reference axis HX1 parallel to the head plate 1270 is greater than a second angle A12 formed by the distribution plate 1520 and the reference axis HX1. Here, the first angle A11 may be 10 to 60 degrees, and the second angle A12 may be 5 to 30 degrees.

Accordingly, the distribution plate 1520 enables air to be sufficiently supplied toward the center of the burner 1220 by imparting a larger vector component, oriented toward the center of the burner 1220, to the flow of air. Here, an extension line passing through a center of the distribution plate 1520 may lead to a center of the inlet 1235 formed in the outer nozzle 1230*b*. Thus, a sufficient amount of air may be supplied to the center of the outer nozzle 1230*b* by the distribution plate 1520, and may be uniformly spread throughout the outer nozzle 1230*b*.

A first distribution channel F11 is defined between the flow distribution member 1500 and the nozzle shroud 1232, and a second distribution channel F12 is defined between the flow distribution member 1500 and the head plate 1270. For example, the second distribution channel F12 may be defined between the flow guide member 1400 and the flow distribution member 1500. Accordingly, the air flowing through the second distribution channel F12 may be stabilized by the flow distribution member 1500 and the flow guide member 1400, thereby suppressing a generation of a swirl.

In addition, a total volume of the second distribution channel F12 may be larger than that of the first distribution channel F11. The second distribution channel F12 may have a volume of 1.2 to 1.5 times larger than the first distribution channel F11. Accordingly, a larger amount of air may flow through the second distribution channel F12, thereby supplying a sufficient amount of air to the center of the nozzle casing 1260.

Meanwhile, a gap GW11 between the nozzle casing 1260 and an extension line EX1 extending toward the central axis of the outer nozzle 1230*b* from an upper end of the flow distribution member 1500 is larger than a gap GW12 between the extension line EX1 and the nozzle shroud 1232. The gap GW11 between the extension line EX1 and the nozzle casing 1260 may be 1.1 to 1.6 times the gap GW12 between the extension line EX1 and the nozzle shroud 1232.

Thus, a large amount of air may flow along an outside of the flow distribution member 1500. The large amount of air flowing along the outside of the flow distribution member 1500 may be guided by the surface toward the head plate 1270 from the distribution plate 1520 to flow into the portion of the outer nozzle 1230*b* adjacent to the inner nozzle 1230*a*.

As described above, according to the exemplary embodiment, the flow distribution member 1500 allows a sufficient amount of air to be supplied to the portion of the outer nozzle 1230*b* positioned adjacent to the center of the burner 1220, thereby uniformly supplying the air to the outer nozzle 1230*b*. In addition, the swirl is suppressed by the flow distribution member 1500 and the flow guide member 1400 so that air can be stably supplied to the outer nozzle 1230*b*.

Figure 6:
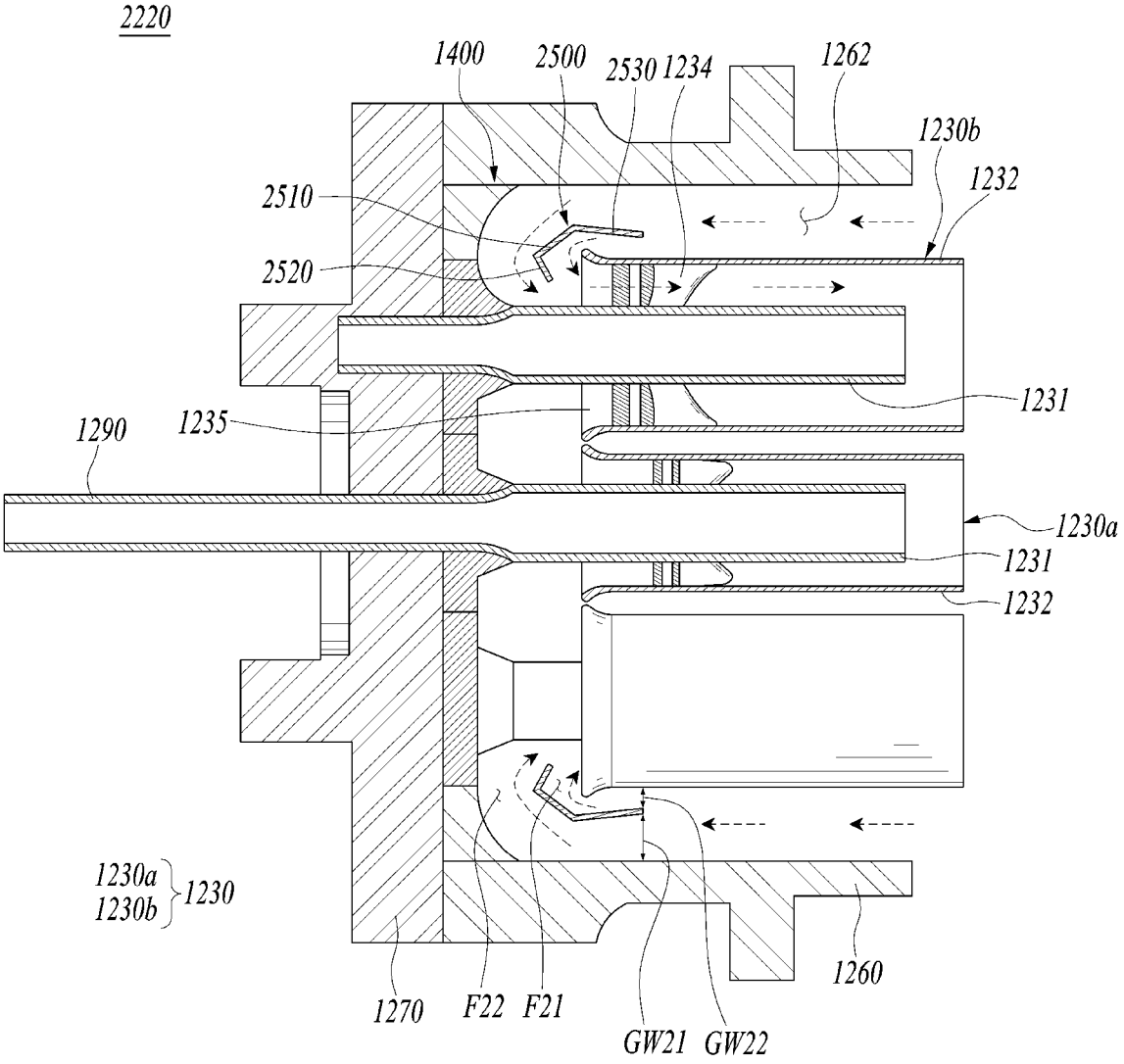
FIG. 6 is a cross-sectional view illustrating a portion of a combustor according to a second exemplary embodiment.
Figure 7:
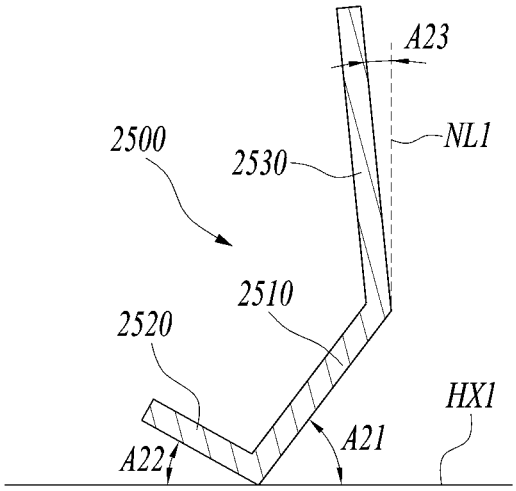
FIG. 7 is a cross-sectional view illustrating a flow distribution member according to the second exemplary embodiment.

FIG. 6 is a cross-sectional view illustrating a portion of a combustor according to a second exemplary embodiment. FIG. 7 is a cross-sectional view illustrating a flow distribution member according to the second exemplary embodiment.

Referring to FIGS. 6 and 7, the combustor according to the second exemplary embodiment has the same structure as the combustor according to the first exemplary embodiment, except for a flow distribution member 2500. Accordingly, a redundant description thereof will be omitted.

The flow distribution member 2500 is installed between the nozzle shroud 1232 and the head plate 1270 to distribute the flow rate of air supplied to the nozzle 1230. The flow distribution member 2500 is spaced apart from the head plate 1270 to divide the channel for air flow into two between the flow distribution member 2500 and the head plate 1270.

The flow distribution member 2500 may have a ring shape, e.g., a circular ring shape. The flow distribution member 2500 may include an outer induction plate 2510, a distribution plate 2520 bent from the outer induction plate 2510, and a guide plate 2530 extending from the outer induction plate 2510 in the direction of introduced air.

The outer induction plate 2510 is disposed further from the center of the burner 2220 than the distribution plate 2520, and the distribution plate 2520 is bent from an inner end of the outer induction plate 2510 to protrude inward. The guide plate 2530 extends from the outer induction plate 2510 in the direction of introduced air and faces the nozzle casing 1260.

A first angle A21 formed by the outer induction plate 2510 and a reference axis HX1 parallel to the head plate 1270 is greater than a second angle A22 formed by the distribution plate 2520 and the reference axis HX1. Here, the first angle A21 may be 10 to 60 degrees, and the second angle A22 may be 5 to 30 degrees.

Accordingly, the distribution plate 2520 enables air to be sufficiently supplied toward the center of the burner 2220 by imparting a larger vector component, oriented toward the center of the burner 2220, to the flow of air. In addition, the guide plate 2530 is inclined at a third angle A23 toward the center of the burner 2220 with respect to a line NL1 parallel to the central axis of the outer nozzle 1230*b*. Here, the third angle A23 may be 2 to 15 degrees. By inclining the guide plate 2530 at the third angle A23 toward the center of the burner 2220, a larger amount of air may be supplied to the outside of the flow distribution member 2500.

A first distribution channel F21 is defined between the flow distribution member 2500 and the nozzle shroud 1232, and a second distribution channel F22 is defined between the flow distribution member 2500, the nozzle casing 1260, and the head plate 1270. The total volume of the second distribution channel F22 may be larger than that of the first distribution channel F21. Thus, a larger amount of air may flow through the second distribution channel F22.

The guide plate 2530 allows the second distribution channel F22 to gradually decrease in cross-sectional area toward the head plate 1270, thereby gradually increasing the flow rate of air. Because air flows at a high speed along the outside of the flow distribution member 2500 and thus has a large momentum, a sufficient amount of air may be supplied toward the center of the burner 2220. In addition, the guide plate 2530 may reduce the generation of turbulence and maintain a laminar flow at the corner.

Meanwhile, a gap GW21 between an upper end of the guide plate 2530 and the nozzle casing 1260 is larger than a gap GW22 between the upper end of the guide plate 2530 and the nozzle shroud 1232. The gap GW21 between the upper end of the guide plate 2530 and the nozzle casing 1260 may be 1.1 to 1.6 times the gap GW22 between the upper end of the guide plate 2530 and the nozzle shroud 1232.

Thus, a large amount of air may flow along an outside of the flow distribution member 2500. The large amount of air flowing along the outside of the flow distribution member 2500 may be guided by the distribution plate 2520 to flow into the portion of the outer nozzle 1230*b* adjacent to the center of the burner 2220.

As described above, according to the exemplary embodiment, because the flow distribution member 2500 includes the guide plate 2530, it is possible to stably guide the flow of air, to easily distribute air, and to uniformly supply air to the nozzle 1230.

Figure 8:
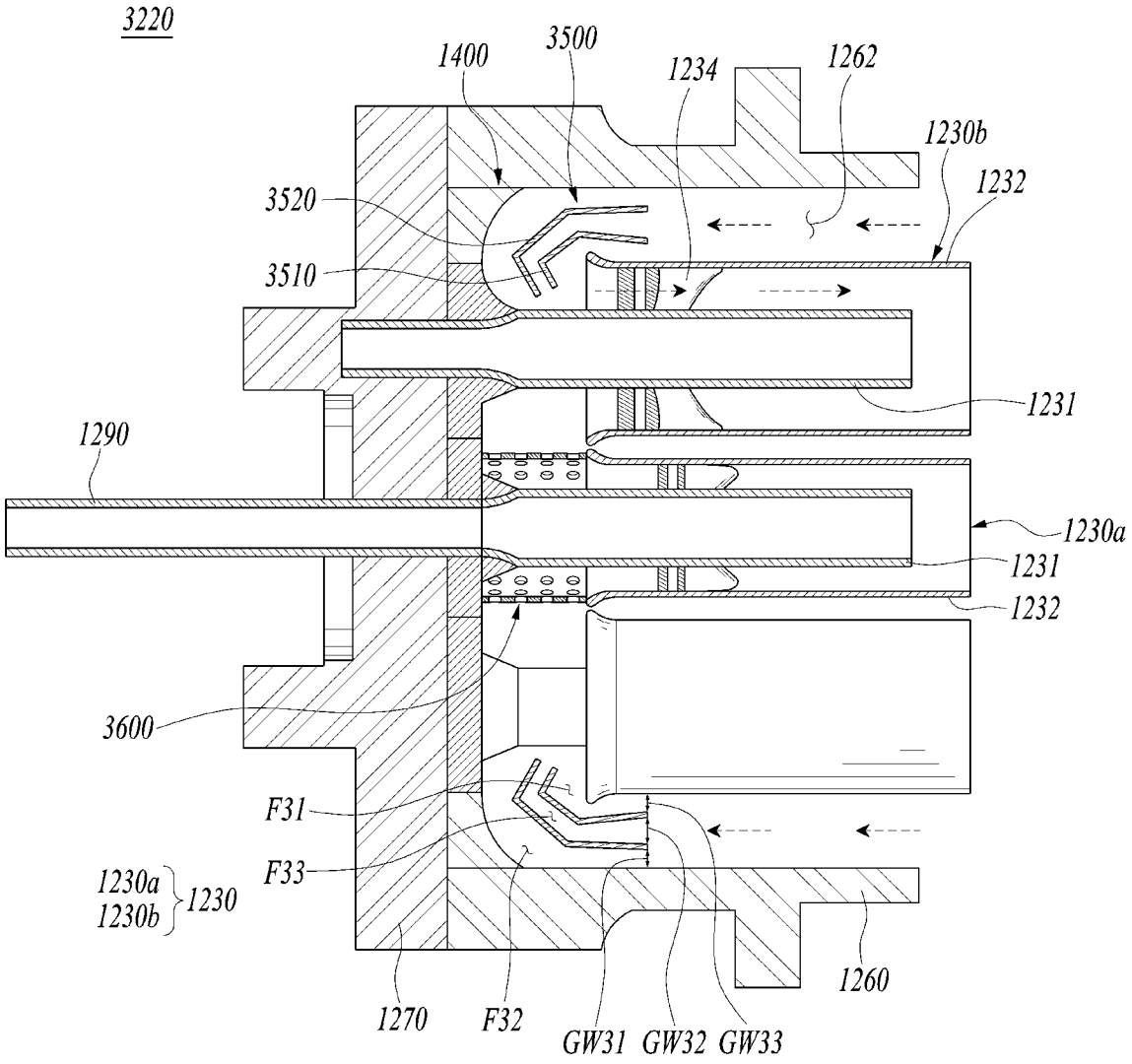
FIG. 8 is a cross-sectional view illustrating a portion of a combustor according to a third exemplary embodiment.
Figure 9:
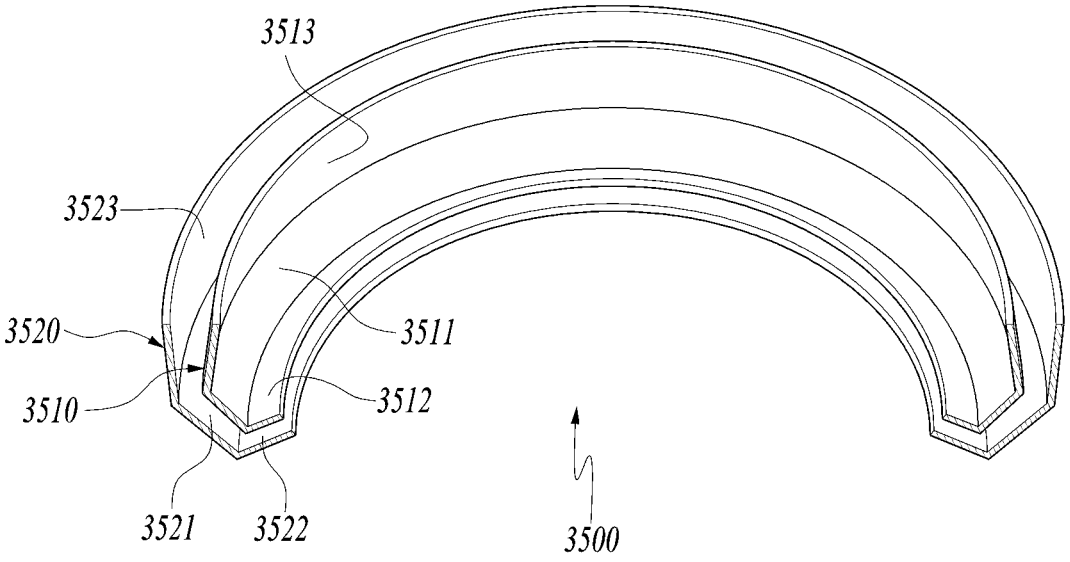
FIG. 9 is a cross-sectional view illustrating a flow distribution member according to the third exemplary embodiment.

FIG. 8 is a cross-sectional view illustrating a portion of a combustor according to a third exemplary embodiment. FIG. 9 is a cross-sectional view illustrating a flow distribution member according to the third exemplary embodiment.

Referring to FIGS. 8 and 9, the combustor according to the third exemplary embodiment has the same structure as the combustor according to the first exemplary embodiment, except for a flow distribution member 3500 and a porous tube 3600. Accordingly, a redundant description thereof will be omitted.

A porous tube 3600 is installed between the inner nozzle 1230*a* and the head plate 1270 in the burner 3220. The porous tube 3600 has a cylindrical shape, and includes a plurality of holes formed on a surface thereof. One end of the porous tube 3600 is fixed to the head plate 1270, and the other end of the porous tube 3600 is fixed to the nozzle shroud 1232 of the inner nozzle 1230*a*. The porous tube 3600 serves to increase flow resistance, which may vary according to the size and number of holes. If the flow resistance of air introduced into the inner nozzle 1230*a* increases, a sufficient amount of air may be supplied to the outer nozzle 1230*b* positioned at the portion adjacent to the inner nozzle 1230*a*.

The flow distribution member 3500 is installed between the nozzle shroud 1232 and the head plate 1270 to distribute the flow rate of air supplied to the nozzle 1230. The flow distribution member 3500 is spaced apart from the head plate 1270 to divide the channel for air flow between the flow distribution member 3500 and the head plate 1270.

The flow distribution member 3500 may include a first flow distribution member 3510 and a second flow distribution member 3520 spaced apart from the first flow distribution member 3510 with a gap therebetween. The first and second flow distribution members 3510 and 3520 may have a ring shape. The first flow distribution member 3510 is positioned between the nozzle shroud 1232 and the second flow distribution member 3520, and the second flow distribution member 3520 is positioned between the nozzle casing 1260 and the first flow distribution member 3510.

The first flow distribution member 3510 may include a first induction plate 3511 inclined with respect to the direction of introduced air, a first distribution plate 3512 bent from an inner end of the first induction plate 3511, and a first guide plate 3513 extending from an outer end of the first induction plate 3511 in the direction of introduced air. The second flow distribution member 3520 may include a second induction plate 3521 inclined with respect to the direction of introduced air, a second distribution plate 3522 bent from an inner end of the second induction plate 3521, and a second guide plate 3523 extending from the second induction plate 3521 in the direction of introduced air.

A first distribution channel F31 may be defined between the first flow distribution member 3510 and the nozzle shroud 1232, a second distribution channel F32 may be defined between the second flow distribution member 3520, the nozzle casing 1260, and the head plate 1270, and a third distribution channel F33 may be defined between the first flow distribution member 3510 and the second flow distribution member 3520.

Meanwhile, a gap GW33 between an upper end of the first guide plate 3513 and the nozzle shroud 1232 may be smaller than a gap GW32 between the upper end of the first guide plate 3513 and an upper end of the second guide plate 3523. The gap GW32 between the upper end of the first guide plate 3513 and the upper end of the second guide plate 3523 may be smaller than or equal to a gap GW31 between the second guide plate 3523 and the nozzle casing 1260. In addition, the gap GW32 between the upper end of the first guide plate 3513 and the upper end of the second guide plate 3523 may gradually decrease toward the head plate 1270.

Accordingly, a large amount of air may be introduced between the first guide plate 3513 and the second guide plate 3523, and may be supplied, through acceleration therebetween, to the portion of the outer nozzle 1230*b* positioned adjacent to the center of the burner 3220 through acceleration. In addition, most of the air introduced between the second guide plate 3523 and the nozzle casing 1260 may be supplied to the inner nozzle 1230*a*, and some may be supplied to the outer nozzle 1230*b*.

As described above, according to the exemplary embodiment, because the flow distribution member 3500 includes the first and second flow distribution members 3510 and 3520, it is possible to uniformly distribute air and supply the distributed air to the nozzle 1230.

Figure 10:
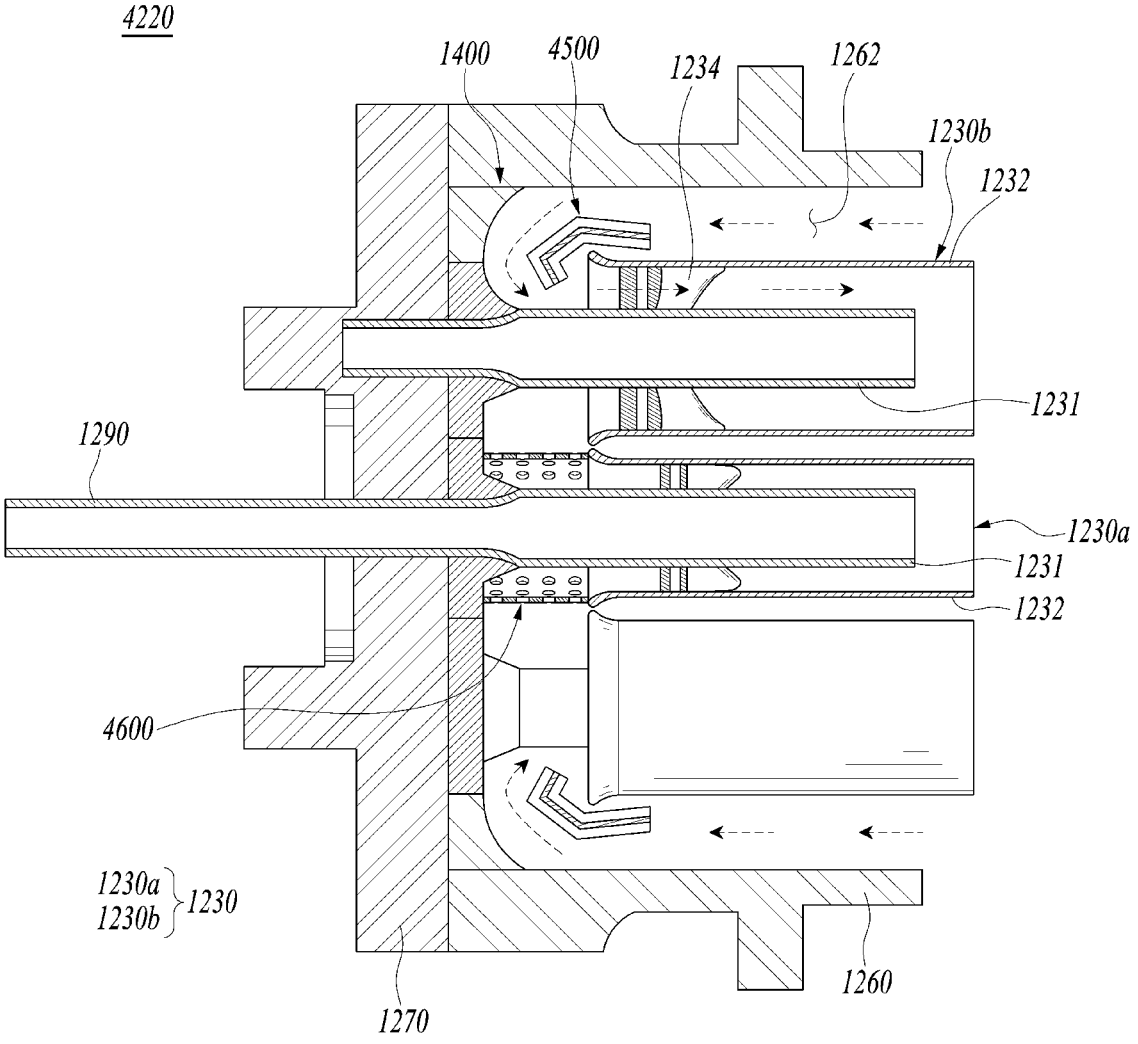
FIG. 10 is a cross-sectional view illustrating a portion of a combustor according to a fourth exemplary embodiment.
Figure 11:
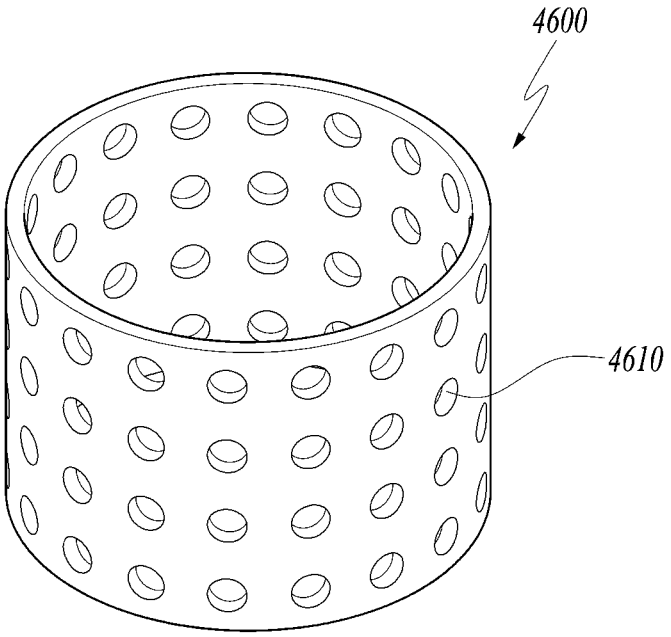
FIG. 11 is a perspective view illustrating a porous tube according to the fourth exemplary embodiment.
Figure 12:
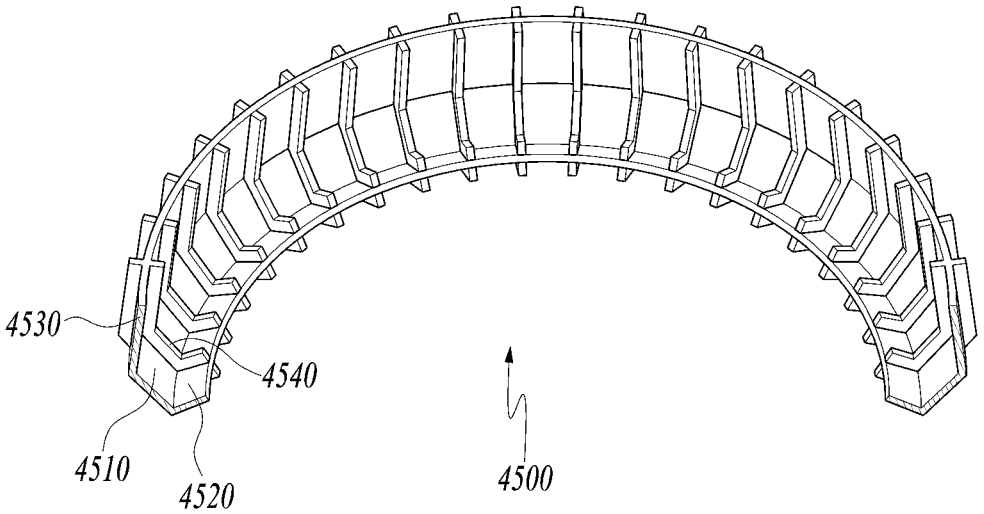
FIG. 12 is a cross-sectional view illustrating a flow distribution member according to the fourth exemplary embodiment.

FIG. 10 is a cross-sectional view illustrating a portion of a combustor according to a fourth exemplary embodiment. FIG. 11 is a perspective view illustrating a porous tube according to the fourth exemplary embodiment. FIG. 12 is a cross-sectional view illustrating a flow distribution member according to the fourth exemplary embodiment.

Referring to FIGS. 10 to 12, the combustor according to the fourth exemplary embodiment has the same structure as the combustor according to the first exemplary embodiment, except for a flow distribution member 4500 and a porous tube 4600. Accordingly, a redundant description thereof will be omitted.

A porous tube 4600 is installed between the inner nozzle 1230*a* and the head plate 1270 in the burner 4220. The porous tube 4600 has a cylindrical shape, and includes a plurality of holes 4610 formed on a surface thereof. The porous tube 4600 may be configured such that one end thereof is fixed to the head plate 1270, and the other end thereof is fixed to the nozzle shroud 1232 of the inner nozzle 1230*a*. The porous tube 4600 serves to increase flow resistance, which may vary according to the size and number of holes 4610. If the flow resistance of air introduced into the inner nozzle 1230*a* increases, a sufficient amount of air may be supplied to the outer nozzle 1230*b* positioned at the portion adjacent to the inner nozzle 1230*a*.

The flow distribution member 4500 is installed between the nozzle shroud 1232 and the head plate 1270 to distribute the flow rate of air supplied to the nozzle 1230. The flow distribution member 4500 is spaced apart from the head plate 1270 to divide the channel for air flow into two between the flow distribution member 4500 and the head plate 1270.

The flow distribution member 4500 may have a ring shape, e.g., a circular ring shape. The flow distribution member 4500 may include an outer induction plate 4510, a distribution plate 4520 bent from the outer induction plate 4510, and a guide plate 4530 extending from the outer induction plate 4510 in the direction of introduced air.

The flow distribution member 4500 may include a plurality of guide ribs 4540 protruding therefrom, and each of the guide ribs 4540 may extend in the direction of flow of air. The guide rib 4540 may extend from an upper end of the outer induction plate 4510 to an end of the distribution plate 4520. The plurality of guide ribs 4540 may be spaced apart from each other in a width direction of the flow distribution member 4500. The guide ribs 4540 may be formed throughout both surfaces of the flow distribution member 4500. The guide ribs 4540 may serve to keep the flow of air uniform and to guide air to flow along the flow distribution member 4500.

As described above, according to the exemplary embodiment, because the porous tube 4600 is installed between the inner nozzle 1230*a* and the head plate 270, it is possible to adjust the flow resistance of air introduced into the inner nozzle 1230*a*. In addition, because the guide ribs 4540 are formed on the flow distribution member 4500, it is possible to more stably guide the flow of air.

According to the combustor and the gas turbine of the exemplary embodiments, it is possible to prevent the generation of the swirl and to reduce the vibration generated during combustion by guiding compressed air.

While one or more exemplary embodiments have been described with reference to the accompanying drawings, it will be apparent to those skilled in the art that various variations and modifications may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A combustor comprising:

a burner including a nozzle casing, a head plate coupled to an end of the nozzle casing, and a plurality of nozzles to inject fuel and air; and a duct assembly coupled to the burner, the fuel being burned in the duct assembly to produce combustion gas, wherein each of the nozzles comprises outer nozzles and an inner nozzle installed inside the outer nozzles, each of the outer nozzles comprises a nozzle tube configured to provide a channel through which air and fuel flow, and a nozzle shroud configured to surround the nozzle tube, and a flow distribution member is installed between the head plate and the nozzle shroud to distribute a flow rate of air introduced into the outer nozzle, wherein the flow distribution member is spaced apart from the nozzle shroud to define a first distribution channel between the flow distribution member and the nozzle shroud, and the flow distribution member is spaced apart from the head plate to define a second distribution channel between the flow distribution member and the head plate, and wherein a flow guide member having a curved guide surface is installed at a corner in which the nozzle casing meets the head plate, and the second distribution channel is defined between the flow guide member and the flow distribution member.

2. The combustor according to claim 1, wherein a volume of the second distribution channel is larger than a volume of the first distribution channel.

3. The combustor according to claim 1, wherein a gap between the nozzle shroud and an extension line, extending toward a central axis of the outer nozzle from an upper end of the flow distribution member, is larger than a gap between the extension line and the nozzle casing.

4. The combustor according to claim 1, wherein the flow distribution member comprises an induction plate and a distribution plate obliquely bent from an inner end of the induction plate.

5. The combustor according to claim 4, wherein a first angle formed by the induction plate and a reference axis parallel to the head plate is greater than a second angle formed by the distribution plate and the reference axis.

6. The combustor according to claim 4, wherein the flow distribution member further comprises a guide plate extending from the induction plate in a direction of introduced air.

7. The combustor according to claim 6, wherein the guide plate is inclined toward a center of the burner with respect to a direction parallel to a central axis of the outer nozzle.

8. The combustor according to claim 6, wherein a gap between an upper end of the guide plate and the nozzle casing is larger than a gap between the upper end of the guide plate and the nozzle shroud.

9. The combustor according to claim 1, wherein the flow distribution member comprises a plurality of guide ribs protruding therefrom, each of the guide ribs extending in a direction of flow of air.

10. A combustor comprising:

a burner including a nozzle casing, a head plate coupled to an end of the nozzle casing, and a plurality of nozzles to inject fuel and air; and a duct assembly coupled to the burner, the fuel being burned in the duct assembly to produce combustion gas, wherein each of the nozzles comprises outer nozzles and an inner nozzle installed inside the outer nozzles, each of the outer nozzles comprises a nozzle tube configured to provide a channel through which air and fuel flow, and a nozzle shroud configured to surround the nozzle tube, and a flow distribution member is installed between the head plate and the nozzle shroud to distribute a flow rate of air introduced into the outer nozzle, wherein the flow distribution member comprises a first flow distribution member and a second flow distribution member spaced apart from the first flow distribution member with a gap therebetween, and the first flow distribution member is disposed between the nozzle shroud and the second flow distribution member, and the second flow distribution member is disposed between the nozzle casing and the first flow distribution member.

11. The combustor according to claim 10, wherein the first flow distribution member comprises a first induction plate inclined with respect to a direction of introduced air, a first distribution plate bent from an inner end of the first induction plate, and a first guide plate extending from an outer end of the first induction plate in the direction of introduced air, and the second flow distribution member comprises a second induction plate inclined with respect to the direction of introduced air, a second distribution plate bent from an inner end of the second induction plate, and a second guide plate extending from an outer end of the second induction plate in the direction of introduced air.

12. The combustor according to claim 11, wherein a gap between an upper end of the first guide plate and the nozzle shroud is smaller than a gap between the upper end of the first guide plate and an upper end of the second guide plate.

13. The combustor according to claim 11, wherein a gap between the first guide plate and the second guide plate gradually decreases toward the head plate.

14. A gas turbine comprising:

a compressor configured to compress air introduced from an outside;

a combustor configured to mix fuel with the air compressed by the compressor and combust a mixture of the fuel and the compressed air; and a turbine including a plurality of turbine blades configured to be rotated by combustion gas produced by the combustor, wherein the combustor comprises:

a burner including a plurality of nozzles to inject fuel and air; and a duct assembly coupled to the burner, the mixture of the fuel and the compressed air being burned in the duct assembly to produce the combustion gas, wherein each of the nozzles comprises outer nozzles and an inner nozzle installed inside the outer nozzles, each of the outer nozzles comprises a nozzle tube configured to provide a channel through which air and fuel flow, and a nozzle shroud configured to surround the nozzle tube, and a flow distribution member is installed between the head plate and the nozzle shroud to distribute a flow rate of air introduced into the outer nozzle, wherein the flow distribution member is spaced apart from the nozzle shroud to define a first distribution channel between the flow distribution member and the nozzle shroud, and the flow distribution member is spaced apart from the head plate to define a second distribution channel between the flow distribution member and the head plate, and wherein a flow guide member having a curved guide surface is installed at a corner in which the nozzle casing meets the head plate, and the second distribution channel is defined between the flow guide member and the flow distribution member.

15. The gas turbine according to claim 14, wherein a volume of the second distribution channel is larger than a volume of the first distribution channel.

* * * * *